US007635027B2

(12) United States Patent
Rankin et al.

(10) Patent No.: US 7,635,027 B2
(45) Date of Patent: Dec. 22, 2009

(54) METHOD AND APPARATUS FOR COMPLETING A HORIZONTAL WELL

(75) Inventors: E. Edward Rankin, Granbury, TX (US); Lloyd A. Hawthorne, Granbury, TX (US)

(73) Assignee: Tolson Jet Perforators, Inc., Granbury, TX (US)

( * ) Notice: Subject to any disclaimer, the term of this patent is extended or adjusted under 35 U.S.C. 154(b) by 117 days.

(21) Appl. No.: 11/671,801

(22) Filed: Feb. 6, 2007

(65) Prior Publication Data

US 2007/0181304 A1 Aug. 9, 2007

Related U.S. Application Data

(60) Provisional application No. 60/771,593, filed on Feb. 8, 2006.

(51) Int. Cl.
*E21B 29/00* (2006.01)
*E21B 43/11* (2006.01)

(52) U.S. Cl. ..... 166/297; 166/250.01; 166/250.02; 166/177.4; 166/252.6; 166/55

(58) Field of Classification Search ..... 166/297, 166/285, 177.4, 298, 252.6, 55, 250.15, 250.01, 166/250.02; 175/4.54, 4.6; 89/1.15; 102/310, 102/322, 204, 223
See application file for complete search history.

(56) References Cited

U.S. PATENT DOCUMENTS 4,194,577 A * 3/1980 Vann ..... 175/4.51
4,484,628 A * 11/1984 Lanmon, II ..... 166/254.2
4,484,632 A * 11/1984 Vann ..... 166/297
4,544,034 A * 10/1985 George ..... 166/297
4,877,089 A * 10/1989 Burns ..... 166/377
4,886,126 A * 12/1989 Yates, Jr. ..... 175/4.54
4,901,802 A * 2/1990 George et al. ..... 175/4.52
5,449,039 A * 9/1995 Hartley et al. ..... 166/297
7,069,992 B2 * 7/2006 Lewis et al. ..... 166/285
2002/0079098 A1 * 6/2002 Clark et al. ..... 166/250.12
2004/0112606 A1 * 6/2004 Lewis et al. ..... 166/372
2004/0238164 A1 * 12/2004 Khomynets et al. .... 166/250.04
2005/0109508 A1 * 5/2005 Vella et al. ..... 166/297

* cited by examiner

*Primary Examiner*—Jennifer H Gay
*Assistant Examiner*—Cathleen R Hutchins
(74) *Attorney, Agent, or Firm*—Bracewell & Giuliani LLP

(57) ABSTRACT

A firing head assembly has a sealed chamber containing a piston, a firing pin, and an impact detonator. The firing head assembly and a perforating charge are installed within a sub and the sub is secured into a string of conduit being lowered into a wellbore. After cementing the conduit, the operator drills out the cement in the conduit, disintegrating the chamber and exposing the sealed chamber to the fluid pressure of the drilling fluid in the conduit. The drilling fluid pressure causes the piston to drive the firing pin against the detonator, which detonates the perforating charge. The operator then pumps down a logging tool to survey the well. Fluid in the conduit below the pump-down head can flow out the displacement perforation into the earth formation while the logging tool is moving downward.

18 Claims, 6 Drawing Sheets

METHOD AND APPARATUS FOR COMPLETING A HORIZONTAL WELL

CROSS-REFERENCE TO RELATED APPLICATION

This application claims priority to provisional application 60/771,593, filed Feb. 8, 2006.

FIELD OF THE INVENTION

This invention relates in general to oil and gas well drilling and in particular to a method of completing a horizontal well that enables a wireline well tool to be pumped down a liner.

BACKGROUND OF THE INVENTION

Highly deviated or horizontal wells are commonly drilled for oil and gas production. As used herein, the term "horizontal" refers to not only wells with truly horizontal sections, but also to wells that are highly deviated. In one type of horizontal well completion, the operator installs and cements a casing or liner that extends to the total depth of the well. Normally, the term "casing" refers to conduit that extends back to the surface wellhead, and "liner" refers to conduit that has its upper end supported near the lower end of a first string of casing. These terms will be used interchangeably herein to refer to a conduit in a well that is cemented in place, whether its upper end extends to the surface or just to the lower end of a first string of casing.

After cementing the casing, the operator perforates through the casing into the producing formation. The operator may then perform other operations, such as hydraulic fracturing or dispensing acid or other chemicals into the producing formation. Normally, the operator installs a string of production tubing in the casing for the production flow.

Even though wells may be fairly close to each other, producing formations often vary in characteristics from one well to another, such as thickness, depth, porosity, water content, permeability and the like. Consequently, it is useful to have a survey or log made of the well before it is cased to provide the characteristics of the producing formation. In highly deviated and horizontal wells, logging can be made while drilling using measuring while drilling techniques.

After cementing, it is also useful for the operator to perform another survey of the well. Because of the casing, the cased-hole log differs from an open-hole survey. By using tools such as ones that measure natural gamma rays emitted by earth formations, the operator will be able to discern the same formations previously noted during the open-hole survey. The operator uses this information to determine precisely where to perforate. Even without an open-hole log, a cased-hole survey provides important information to the operator.

In a vertical or even a moderately deviated well, the operator can run a cased-hole log before perforating by lowering a surveying instrument on a wireline into the casing and making the survey either while running-in or retrieving. Logging a cased horizontal well presents a problem, because gravity won't pull the tool down. One approach has been to mount to the instrument a tractor with motor-driven wheels or tracks. Generally, these logging procedures are expensive and slow. Also, high voltages are typically required, which can be detrimental to the wireline.

Surveying instruments have been pumped down wells in the prior art. An annular piston is mounted to the instrument assembly for sealingly engaging the conduit. This type of operation requires a flow path for displaced fluid below the piston as the instrument moves downward. In the prior art, the flow path typically comprises an open annulus surrounding the conduit containing the instrument. In a cased horizontal well, there is no open annulus surrounding the casing and no place for displaced fluid. Consequently, pump-down logging is normally not performed on horizontal wells.

SUMMARY

In this invention, the operator runs and cements a conduit, such as a liner or casing in a wellbore. The operator then forms one or more displacement perforations through the conduit and surrounding cement and into an earth formation. He then pumps down a wireline logging tool with a pump-down head. The downward movement of the pump-down head causes some of the fluid below the pump-down head to be displaced out through the displacement perforation into the formation. While the logging tool is in the conduit, the operator performs a survey of the well.

Preferably, the operator forms the displacement perforation with a firing head assembly comprising a sealed chamber containing a piston, a firing pin, and an impact detonator. The firing head assembly is mounted within a sub and the impact detonator is linked to a perforating charge. The operator secures the sub to the string of conduit as it is being lowered into the wellbore.

After cementing, the operator lowers a drill bit into the conduit and drills out cement left in the sub and in the lower portion of the conduit. The drill bit ruptures the sealed chamber of the firing head assembly, which exposes the sealed chamber to drilling fluid pressure. The fluid pressure causes the piston to drive the firing pin against the detonator, thereby detonating the perforating charge.

DETAILED DESCRIPTION OF THE INVENTION

Figure 1:
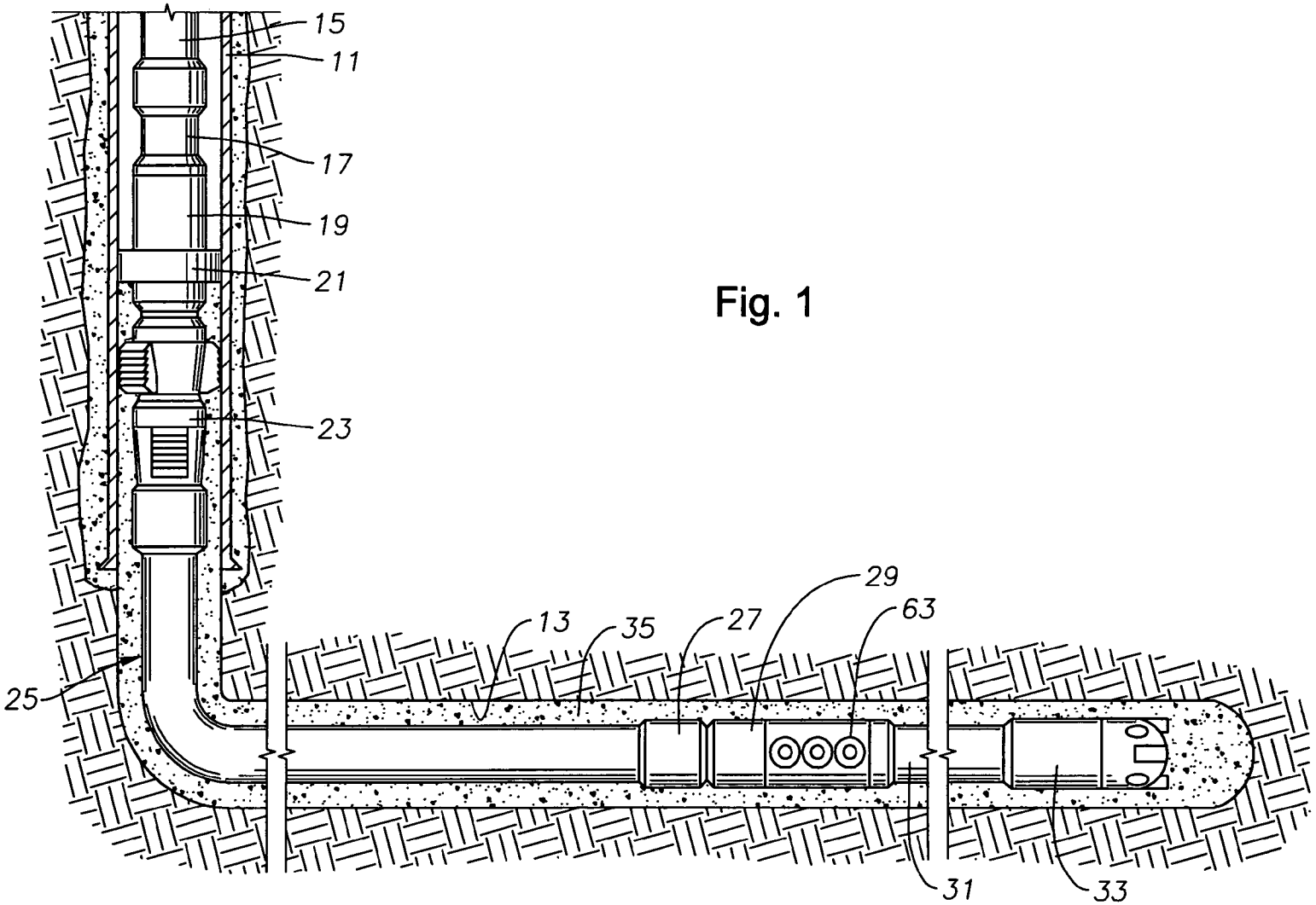
FIG. 1 is a schematic sectional view illustrating a well with a liner having a displacement sub in accordance with this invention, the liner being shown after cementing but before displacement perforations have been made.

Referring to FIG. 1, the well has a vertical section with a conventional string of casing 11 that is cemented in place. The operator has drilled an open hole section 13 below casing 11 open hole section 13 having a substantially horizontal portion that may extend thousands of feet. In the embodiment of FIG. 1, a string of drill pipe 15 is shown extending into the casing 11. A setting tool 17 is located on the lower end of drill pipe 15. Setting tool 17 is connected to a tieback extension 19, which in turn is connected to a packer 21. Packer 21 is connected to a liner hanger 23. A liner 25 is secured to liner hanger 23 for securing the upper end of liner 25 to the inner diameter of casing 11. Liner 25 is a string of casing smaller in diameter than the casing 11. Rather than having its upper end near the lower end of casing 11, liner 25 could have its upper end at the surface. Liner 25 is shown in the process of being installed with its upper end a short distance above the lower end of casing 11 and its lower end near the bottom of the well. Setting tool 17, tieback extension 19, packer 21 and hanger 23 are conventional components used to set liner 25.

Liner 25 has a landing collar 27 at its lower end for receiving a conventional cement plug (not shown). A displacement sub 29 constructed in accordance with this invention is secured to the lower end of landing collar 27. An extension member 31, which may be a section of the same pipe as liner 25, extends below displacement sub 29. A conventional cement set shoe 33 is secured to the lower end of extension member 31.

After running liner 25, the operator pumps cement down liner 25, landing collar 27, displacement sub 29, extension member 31 and cement shoe 33. Cement 35 flows out cement shoe 33 and back up the annulus in open hole 13 surrounding liner 25, as illustrated in FIG. 1. After dispensing the desired amount of cement, the operator pumps down a conventional drillable plug (not shown), which lands in landing collar 27. Cement 35 will cure not only in the annulus surrounding landing collar 27, extension member 31, displacement sub 29, and liner 25, but also within extension member 31 and displacement sub 29. Immediately after pumping cement 35, the operator sets packer 21 and retrieves the string of drill pipe 15 and setting tool 17.

Figure 2:
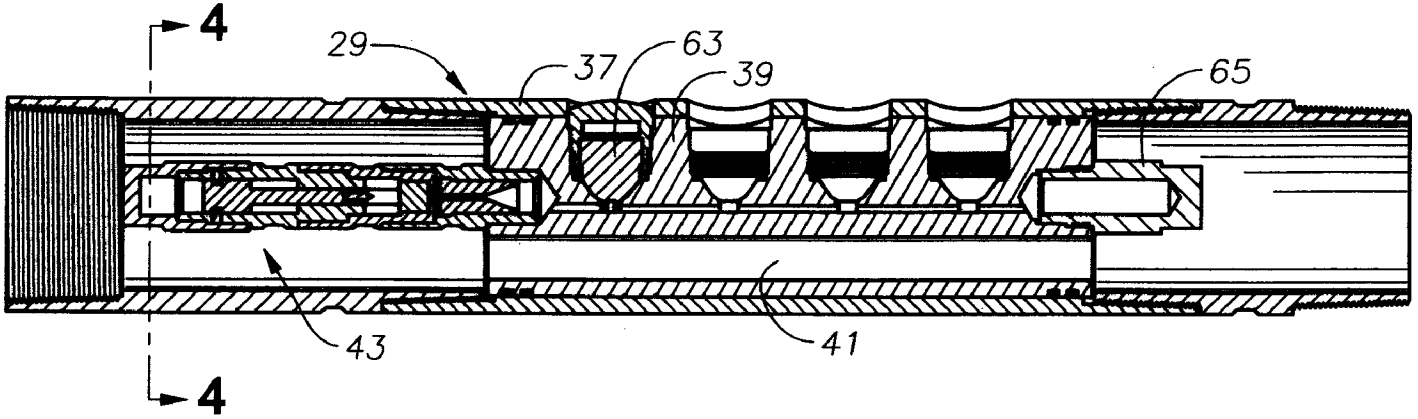
FIG. 2 is an enlarged sectional view of the displacement sub of FIG. 1, shown removed from the liner.
Figure 4:
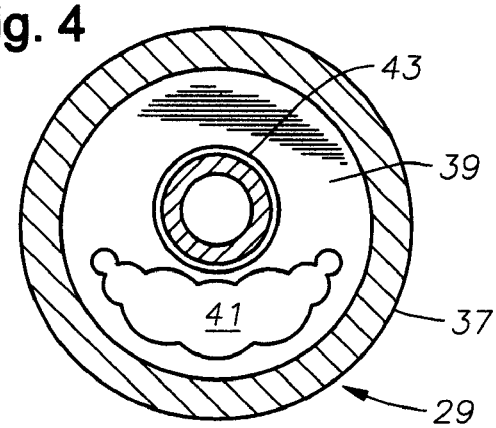
FIG. 4 is a sectional view of the displacement sub of FIG. 1, taken along the line 4-4 of FIG. 2, and shown prior to cementing.
Figure 5:
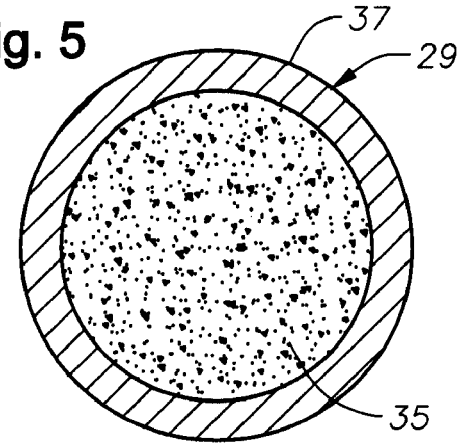
FIG. 5 is a sectional view of the displacement sub of FIG. 1, taken along the line 4-4 of FIG. 2, and shown after cementing.

Referring to FIG. 2, displacement sub 29 has a tubular steel housing 37 of substantially the same diameter as liner 25. Housing 37 contains a body 39 of a drillable material, such as aluminum, brass or composite. Body 39 is a cylindrical member that is sealingly secured within housing 37. Body 39 has a flow port 41 extending from its upper end to its lower end for fluid circulation prior to cementing and also for cement 35 flow. As shown in FIG. 4, flow port 41 may be crescent-shaped, and it is offset from the longitudinal axis of body 39. Prior to pumping the cement through displacement sub 29, flow port 41 is open. As shown in FIG. 5, after pumping cement 35, the cement will cure within and block flow port 41.

Figure 3:
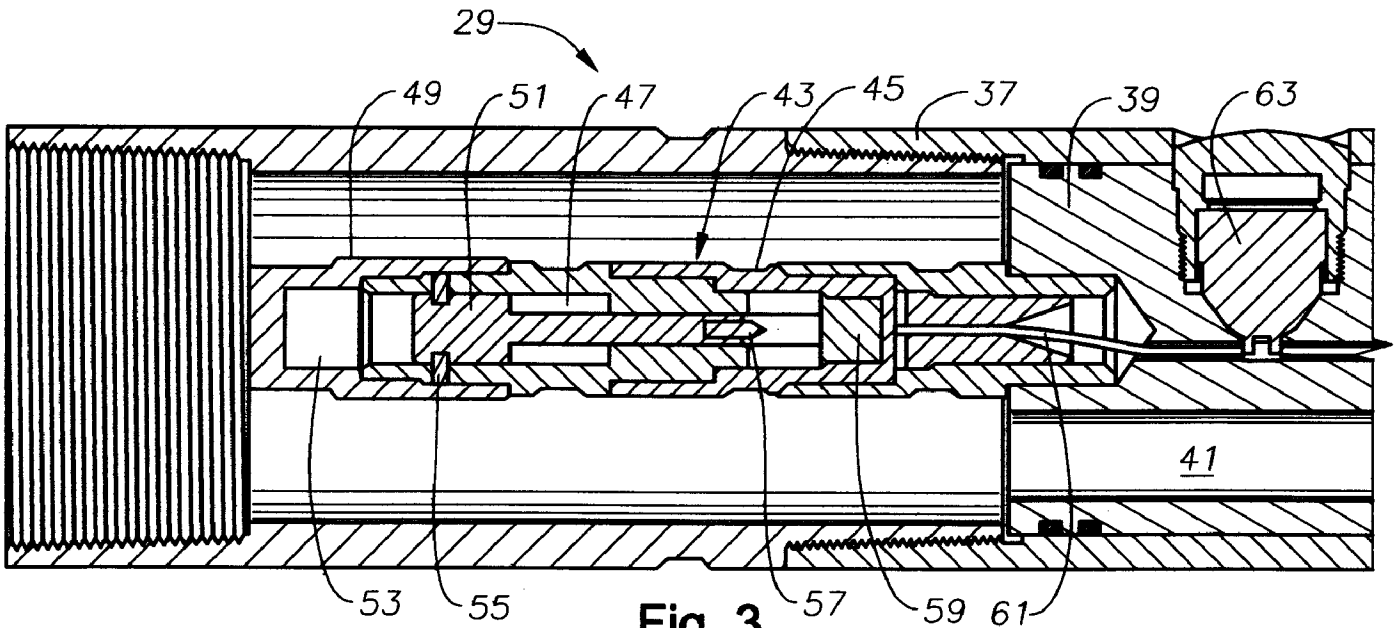
FIG. 3 is a further enlarged sectional view of the firing head assembly of the displacement sub of FIG. 2.

Referring to FIG. 3, a firing head assembly 43 is secured by threads into the upper end of body 39. Firing head assembly 43 is also of drillable materials and is offset from the axis of body 39. Firing head assembly 43 has a housing 45 made up of a number of tubular sections secured and sealed together as shown in FIG. 3. A bore 47 is located within an upper portion of firing head housing 45. Firing head housing 45 has a cap 49 that encloses the upper end of bore 47. A piston 51 is carried within bore 47 for movement from the initial position shown in FIG. 3 to a lower position (not shown). Piston 51 is initially spaced with its upper end below cap 49. A chamber 53 at atmospheric pressure is located between the upper end of piston 51 and cap 49. Piston 51 sealingly engages bore 47 and is held in the initial position by shear pins 55. Piston 51 has a downward extending rod with a sharp firing pin 57 fixed to its lower end.

A percussive detonator 59 is located within firing head housing 45 a short distance below firing pin 57. Detonator 59 is connected to detonating cord 61, which leads to one or more shaped or perforating charges 63 (only one shown in FIGS. 2 and 3). Detonator 59, detonating cord 61 and shaped charges 63 are conventional components used in perforating operations. The number of shaped charges 63 can vary.

Referring to FIG. 2, an optional dye pack housing 65 is secured by threads to the lower end of body 39. Dye pack housing 65 is also of drillable material and has a sealed chamber that contains a dye. When exposed to well bore fluid, the dye will discolor the fluid circulating back to the surface to indicate that displacement sub 29 has been drilled through.

Figure 7:
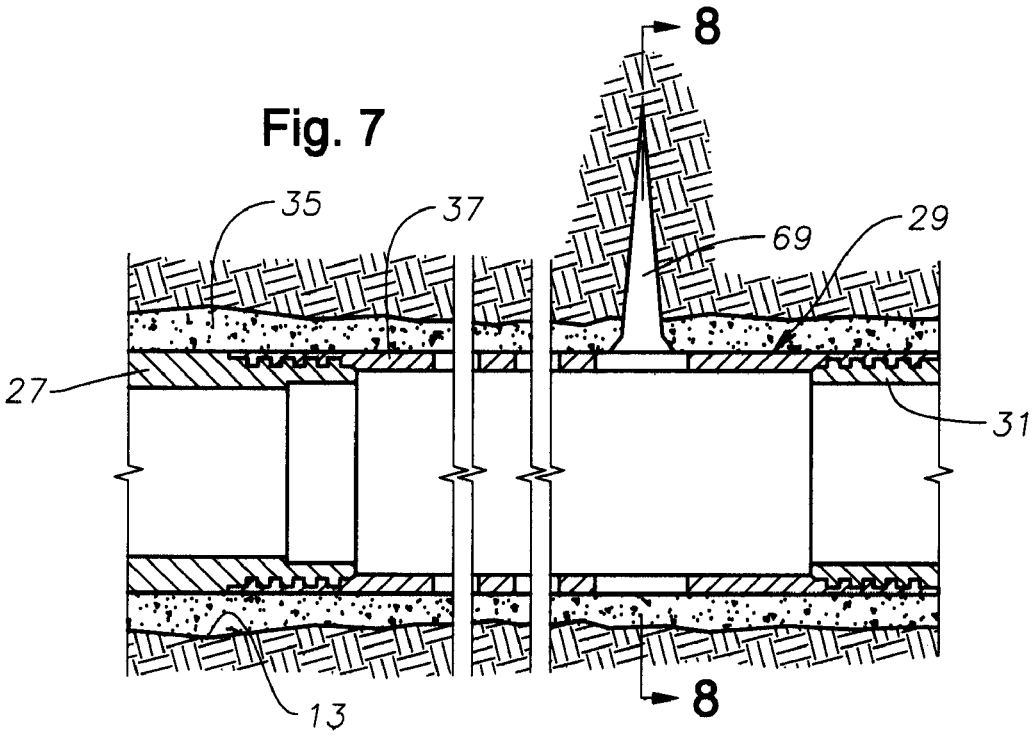
FIG. 7 is an enlarged sectional view of the displacement sub as shown in FIG. 6, after it has been drilled through and the displacement perforations made.
Figure 8:
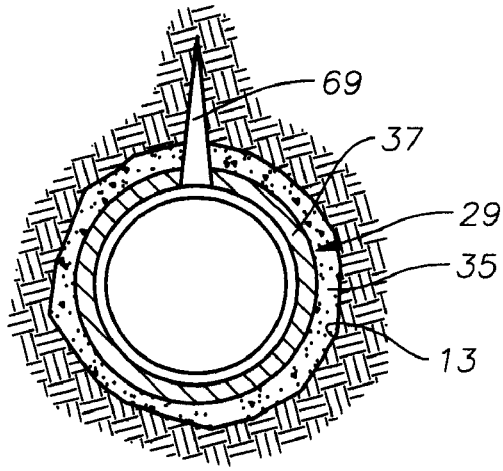
FIG. 8 is a sectional view of the displacement sub as shown in FIG. 7, taken along the line 8-8 of FIG. 7.
Figure 6:
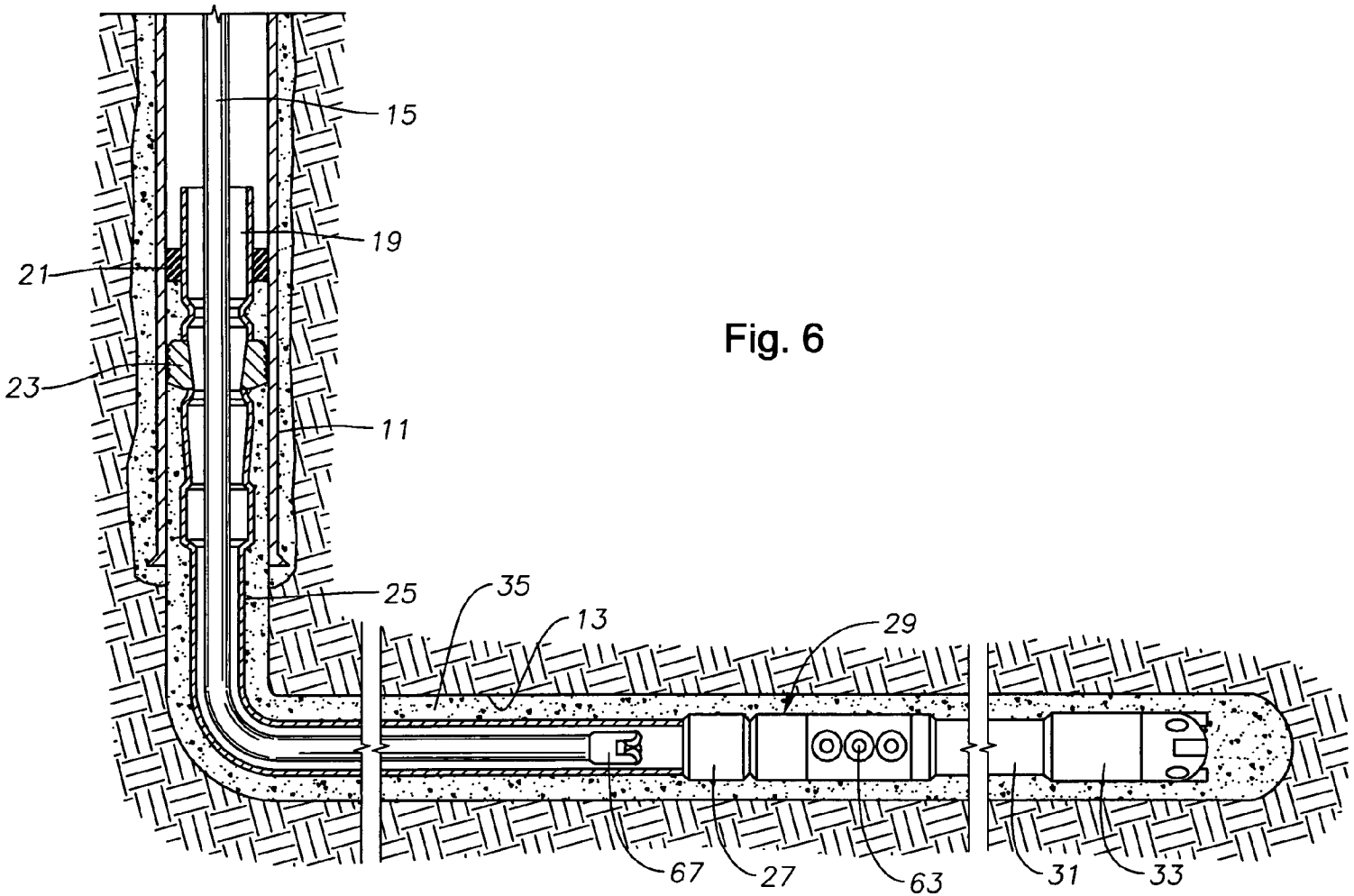
FIG. 6 is a sectional view similar to FIG. 1, but showing a drill string drilling through the interior of the displacement sub after cementing.

Referring to FIG. 6, after cement 35 is cured and the operator has removed setting tool 17 (FIG. 1), the operator runs back into the well with a drill bit 67 on the lower end of drill pipe 15. Drill bit 67 will drill the cement plug (not shown) in collar 27, and then began drilling components of displacement sub 29. During drilling, the operator pumps drilling fluid through drill pipe 15, which discharges from drill bit 67 and flows back up the annulus between drill pipe 15 and liner 25. Once drill bit 67 drills through cap 49 (FIG. 3), the pressure of the drilling fluid will be applied to chamber 53, which was previously at atmospheric pressure. The drilling fluid pressure causes shear pins 55 to shear, pushing piston 51 and firing pin 57 downward. Firing pin 57 strikes and ignites detonator 59, which in turn ignites detonating cord 61 and shaped charges 63. The explosion creates perforations 69 through cement 35 and into the earth formation as illustrated in FIGS. 7 and 8.

After firing, the operator continues drilling firing head assembly 43 (FIG. 3) and body 39 (FIG. 2). When drill bit 67 reaches dye pack assembly 65, the dye is released. The fluid being pumped down drill string 15 causes dye 66 to color the drilling fluid returning to the surface, indicating to the operator that he has now drilled through displacement sub 29. Tile operator stops drilling substantially at this point, leaving cement 35 within extension member 31 and cement shoe 33. The operator then retrieves drill pipe 15 and drill bit 67 (FIG. 6).

Figure 9:
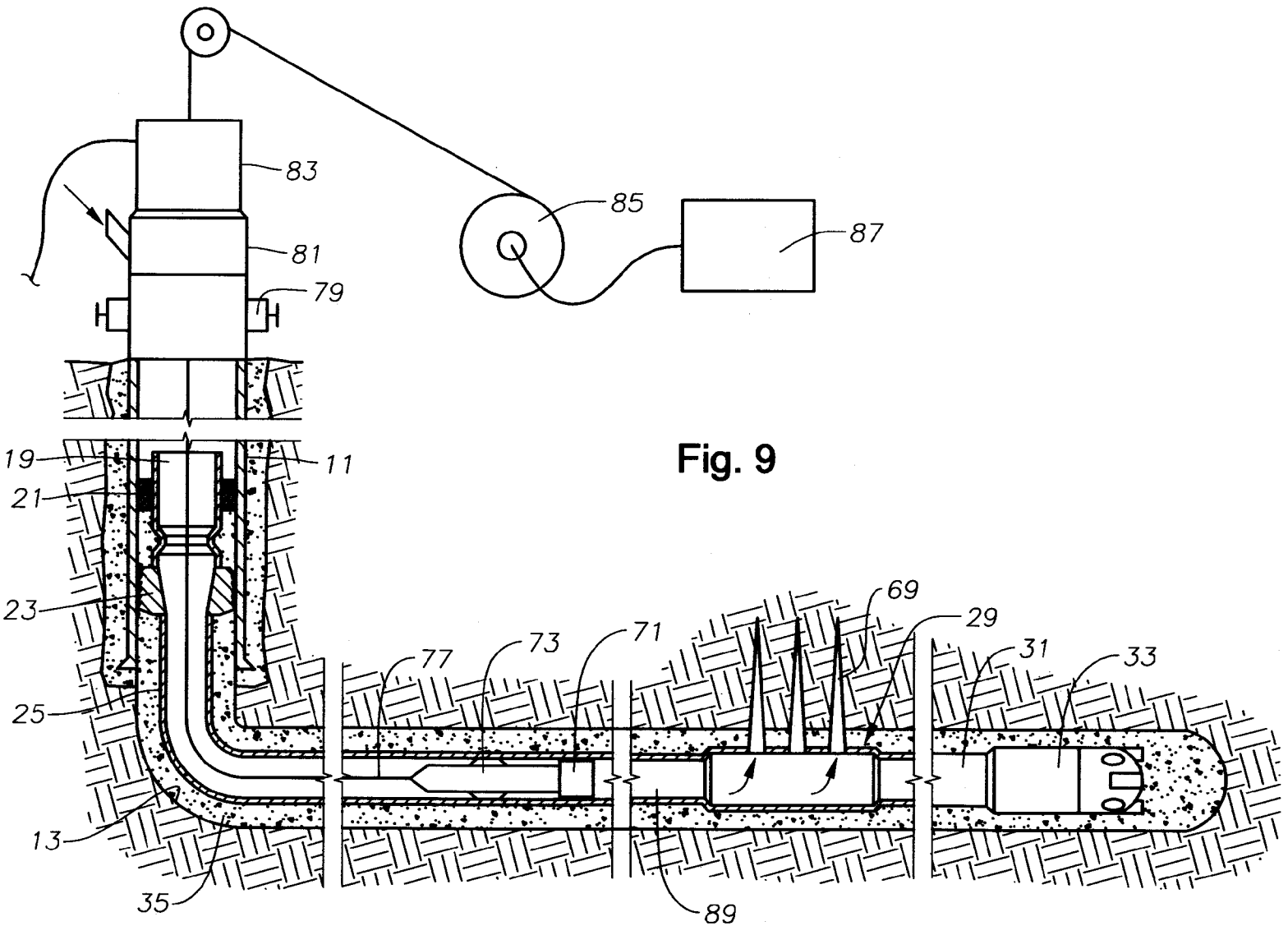
FIG. 9 is a sectional view of a logging instrument being pumped down the liner of FIG. 1.

Referring to FIG. 9, the operator may now perform wireline services in the well, using a wireline tool 73. Wireline tool 73 may be any type of conventional wireline service equipment, such as a gamma ray wireline tool, a cement bond wireline tool, perforating equipment or a plug or packer setting tool. Wireline tool 73 may be attached to a pump-down head 71 to facilitate pumping down liner 25. Pump-down head 71 is piston-like member that fits closely within tile inner diameter of liner 25. Because of their large diameter, some wireline tools 73, such as a bridge plug, may not need an additional pump down head 71. Pump down head 71 is located at the lower end of wireline tool 73, which is connected to an electrical cable 77 that leads to the surface.

At the surface, a blowout preventer 79 will close the well in the event of an emergency. Blowout preventer 79 may include wireline rams that close around electrical cable 77 as well as shear rams that will cut it. A manifold 81 is secured to blowout preventer 79 for pumping fluid, typically water, into casing 11 and liner 25 to force pump-down head 71 downward. A lubricator 83 seals around electrical cable 77 as it moves. Electrical cable 77 is dispensed by a winch 85 at the surface. A logging unit 87 supplies electrical power to electrical cable 77 and receives signals indicating parameters of the earth formations and cement 35.

As illustrated in FIG. 9, fluid 89 is located below pump-down head 71. As pump-down head 71 moves downward, it displaces some of the fluid 89, which flows into displacement perforations 69. The exterior of pump-down head 71 does not form a tight seal with the inner diameter of liner 25; rather a small clearance will exist for some of the fluid 89 to flow around pump-down head 71 as it moves downward. However, without displacement perforations 69, it would not be feasible to pump wireline tool 73 to the lower end of liner 25. Preferably, the operator continues pumping down pump-down head 71 until it reaches the lower end of displacement sub 29.

Subsequently, the operator will retrieve pump-down head 71 and tool 73 by winding electrical cable 77 back onto winch 85. The operator may perform the log while retrieving tool 73, or while pumping tool 73 down, or both. The operator then may complete the well by running production tubing and perforating in a variety of conventional manners.

Figure 10:
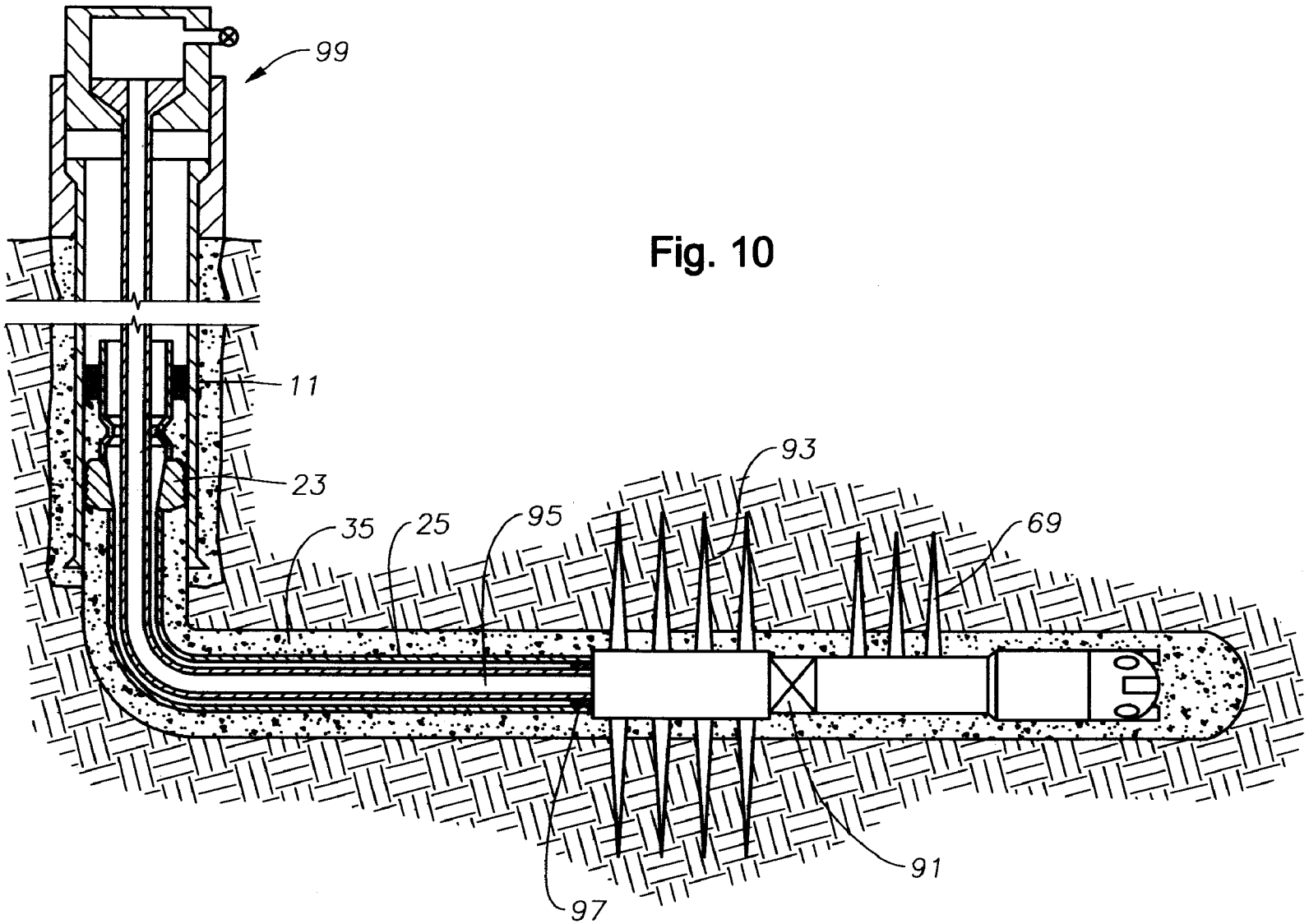
FIG. 10 is a sectional view of the well of FIG. 1 after final perforating and installation of production tubing.

Referring to FIG. 10, in one completion method, the operator perforates to form production perforations 93 above displacement perforations 69. The production perforations 93 could be made in several ways, one of which could be pumping down through liner 25 a pump-down perforating gun on wireline, with displaced fluid flowing out displacement perforations 69. A bridge plug 91 could then be set above the displacement perforations 69 to isolate them from production perforations. The operator may then run a string of production tubing 95 and set a packer 97 in liner 25 above production perforations 93. Tubing 95 is suspended conventionally from a wellhead assembly 99 for conveying well fluid to the surface.

Alternately, the operator could first set bridge plug 91, then run tubing 95, then pump down a perforating gun through tubing 95 with displaced fluid flowing back up the tubing annulus within liner 25 before setting packer 97. The operator could also make the production perforations with a tubing conveyed perforating gun.

The invention has significant advantages. By forming a displacement perforation into the formation, the operator can use a pump-down logging tool, with displacement fluid flowing into the formation. Forming the displacement perforation while drilling out the cement avoids an additional trip just to make the displacement perforation. This method avoids the need for a tractor, thus saving time and expense.

While the invention has been shown in only one of its forms, it should be apparent to those skilled in the art that it is not so limited but is susceptible to various changes without departing from the scope of the invention.

The invention claimed is:

1. A method of completing a well, comprising:

(a) providing a firing head assembly comprising a sealed chamber containing a piston for movement along a firing head axis, a firing pin axially aligned with the piston, and an impact detonator axially aligned with the firing pin;

(b) installing the firing head assembly within a sub and linking the impact detonator to a perforating charge;

(c) securing the sub to a string of conduit and lowering the conduit into a wellbore;

(d) lowering a drill bit into the conduit, pumping drilling fluid through the drill bit into the conduit and rotating the drill bit against the firing head assembly to disintegrate at least a portion of the sealed chamber, thereby exposing the sealed chamber to the fluid pressure of the drilling fluid in the conduit; and (e) in response to the fluid pressure, the piston driving the firing pin against the detonator, causing the perforating charge to detonate to create a perforation through the conduit and into an earth formation.

2. The method according to claim 1, after step (c) and before step (d):

pumping cement through the conduit and around the firing head assembly in the sub and out a lower end of the conduit;

pumping a cement plug down the conduit, pushing the cement out of the conduit and back up an annulus surrounding the conduit and landing the cement plug adjacent the firing head assembly, thereby leaving the firing head assembly immersed in the cement; and allowing the cement to cure before step (d).

3. The method according to claim 1, further comprising after step (e):

attaching a selected tool to a line, the tool having a pump-down head;

placing the tool in the conduit with the pump-down head sealingly engaging the conduit; and applying fluid pressure to the conduit to pump the tool down the conduit while reeling out the line and pushing fluid in the conduit below the tool out the perforation.

4. The method according to claim 3, further comprising:

performing a wireline survey with the tool while within the conduit.

5. The method according to claim 4, further comprising:

after performing the wireline survey, perforating a selected portion of the conduit to create production perforations, running a string of tubing into the conduit, segregating said first mentioned perforation from an inlet of the tubing, and flowing well fluid from the production perforations into the tubing.

6. The method according to claim 1, further comprising:

before step (c), placing a dye within a dye chamber and mounting the dye chamber within the sub below the firing head assembly;

disintegrating at least part of the dye chamber with the drill bit in step (d), thereby releasing the dye into the drilling fluid; and flowing the dye along with the drilling fluid back up the conduit so as to provide an indication that the drill bit has drilled through the firing head assembly.

7. The method according to claim 1, further comprising maintaining the sealed chamber at atmospheric pressure in step (c) until at least a portion of the sealed chamber is disintegrated by the drill bit.

8. A method of performing a downhole operation on a well, comprising:

(a) providing a firing head assembly comprising a sealed chamber containing a piston for downward movement, a firing pin below the piston, and an impact detonator below the firing pin;

(b) installing the firing head assembly and a perforating charge within a sub;

(c) securing the sub to a string of conduit and lowering the conduit into a wellbore; then (d) pumping cement down the conduit, through the sub around the firing head assembly, and out a lower end of the conduit into the wellbore; then (e) lowering a drill bit into the conduit, pumping drilling fluid through the drill bit into the conduit and rotating the drill bit against the firing head assembly to disintegrate at least a portion of the sealed chamber, thereby exposing the sealed chamber to the fluid pressure of the drilling fluid in the conduit;

(f) in response to the fluid pressure, the piston driving the firing pin against the detonator, causing the perforating charge to detonate to create a displacement perforation through the conduit, a portion of the cement and into an earth formation; then (g) providing a logging tool with a pump-down head and lowering the logging tool on a wireline into the conduit and pumping fluid into the conduit above the pump-down head of the logging tool to pump the logging tool down the conduit, the downward movement of the pump-down head causing at least some fluid in the conduit below the pump-down head to flow out the displacement perforation into the earth formation, then retrieving the logging tool on the wireline; and (h) performing a well survey with the logging tool while the logging tool is in the conduit.

9. The method according to claim 8, further comprising:

after performing step (g), perforating a selected portion of the conduit to create production perforations, running a string of tubing into the conduit, segregating the displacement perforation from an inlet of the tubing, and flowing well fluid from the production perforations into the tubing.

10. The method according to claim 8, further comprising:

before step (c), placing a dye within a dye chamber and mounting the dye chamber within the sub below the firing head assembly;

disintegrating at least part of the dye chamber with the drill bit in step (e), thereby releasing the dye into the drilling fluid; and flowing the dye along with the drilling fluid back up the conduit so as to provide an indication that the drill bit had drilled through the firing head assembly.

11. The method according to claim 8, further comprising maintaining the sealed chamber at atmospheric pressure in step (e) until at least a portion of the sealed chamber is disintegrated by the drill bit.

12. An apparatus for completing a well, comprising:

a sub for connection into a string of conduit to be lowered into the well;

a support within the sub for holding a perforating charge;

a firing head assembly mounted in the sub and comprising:

a housing having a sealed chamber with a closed upper end that is immovable relative to the housing in response to well fluid pressure applied to an exterior of the housing;

a piston located in and defining a bottom of the chamber for downward movement relative to the housing in response to an increase in pressure in the chamber, the piston being isolated by the closed upper end from well fluid pressure applied to the exterior of the housing;

a firing pin below the piston for delivering a blow to an impact detonator below the firing pin within the housing; and wherein the closed upper end of the housing is constructed of a material readily disintegrable by a well drill bit, so that the drill bit when lowered into the conduit and rotated against the end of the housing, exposes the chamber to drilling fluid pressure contained in the conduit, causing the piston to drive the firing pin against the detonator, which causes the perforating charge to detonate to create a displacement perforation through the conduit.

13. The apparatus according to claim 12, wherein the firing head assembly has an axis offset and parallel to a longitudinal axis of the sub to reduce a tendency of the firing head assembly to rotate in response to rotation of the well drill bit.

14. The apparatus according to claim 12, wherein the firing pin is mounted to the piston for movement therewith.

15. The apparatus according to claim 12, wherein the support comprises:

a body mounted within the sub, the body having upper and lower ends, a passage extending between the upper and lower ends, and an outward-facing receptacle on an exterior portion of the body for receiving the perforating charge; and wherein the body is formed of a material readily disintegrable by the well drill bit.

16. The apparatus according to claim 15, wherein the firing head assembly is secured to the upper end of the body.

17. The apparatus according to claim 15, wherein:

the body has a cylindrical outer diameter; and the passage is eccentric relative to a longitudinal axis of the body.

18. The apparatus according to claim 12, further comprising:

a dye container mounted in the sub for hold a dye, the dye container being of a material readily disintegrable by the well drill bit for releasing dye into the drilling fluid when breached by the drill bit.

* * * * *